US005792946A

United States Patent [19]

Chastonay

[11] Patent Number: 5,792,946

[45] Date of Patent: Aug. 11, 1998

[54] PENDULUM LENGTH BALANCING OF GOLF CLUBS INCLUDING GRAPHITE SHAFTED GOLF CLUBS

[76] Inventor: Herman A. Chastonay, 6455 Potomac, St. Louis, Mo. 63139

[21] Appl. No.: 804,221

[22] Filed: Feb. 21, 1997

Related U.S. Application Data

[63] Continuation-in-part of Ser. No. 627,740, Apr. 2, 1996, Pat. No. 5,608,160.

[51] Int. Cl.[6] ..... A63B 53/00

[52] U.S. Cl. ..... 73/65.03; 473/292

[58] Field of Search ..... 73/65.03, 65.06; 473/287, 291, 292

[56] References Cited

U.S. PATENT DOCUMENTS

| | | | |
|---|---|---|---|
| 1,594,801 | 8/1926 | Stackpole | 73/65.03 X |
| 1,953,916 | 4/1934 | Adams | 73/65.03 |
| 2,062,673 | 12/1936 | Ogg et al. | 73/65.03 |
| 2,108,877 | 2/1938 | Wettlaufer | 73/65.03 |
| 2,307,877 | 1/1943 | Chapman | 73/65.03 X |
| 2,595,717 | 5/1952 | Smith | 73/65.03 |
| 2,727,384 | 12/1955 | Brandon | 73/65.03 |
| 3,577,771 | 5/1971 | Solheim | 73/65.03 |
| 3,698,239 | 10/1972 | Everett, III | 73/65.03 |
| 3,703,824 | 11/1972 | Osborne et al. | 73/65.03 |
| 3,785,197 | 1/1974 | Finn | 73/65.03 |
| 4,043,184 | 8/1977 | Sayers | 73/65.03 |
| 4,058,312 | 11/1977 | Stuff et al. | 73/65.03 X |
| 4,212,193 | 7/1980 | Turley | 73/65.03 X |
| 4,261,566 | 4/1981 | MacDougall | 73/65.03 X |
| 4,603,577 | 8/1986 | Johnson et al. | 73/65.03 |
| 4,866,979 | 9/1989 | Bernhardt | 73/65.03 |
| 5,094,101 | 3/1992 | Chastonay | 73/65.03 |
| 5,277,059 | 1/1994 | Chastonay | 73/65.03 |
| 5,285,680 | 2/1994 | Sun | 73/65.03 |
| 5,318,296 | 6/1994 | Adams et al. | 73/65.03 X |
| 5,417,108 | 5/1995 | Chastonay | 73/65.03 |
| 5,569,097 | 10/1996 | Veux et al. | 73/65.03 X |
| 5,608,160 | 3/1997 | Chastonay | 73/65.03 |

*Primary Examiner*—Elizabeth L. Dougherty
*Attorney, Agent, or Firm*—Haverstock, Garrett & Roberts

[57] ABSTRACT

A method for dynamically balancing any one or a plurality of golf clubs wherein each club in the plurality of clubs is balanced to the same equivalent pendulum length, the present method being based upon simulating the dynamic characteristics associated with swinging any particular golf club by using the dynamic equations describing simple pendulum motion wherein the equivalent pendulum length of any particular golf club is represented by any one of the following equations:

$$EPL = \frac{2Q + r}{3} \quad (1)$$

$$EPL = \frac{Q + K}{2} \quad (2)$$

$$EPL = \sqrt{Q \times K} \quad (3)$$

where EPL=the equivalent pendulum length of the club; Q=the shaft or center of percussion length of the club; r=distance between the center of gravity of the club and the grip end thereof; and K=the radius of gyration of the club. The present method also automatically balances all clubs in any particular plurality of clubs to a common period of oscillation and is particularly adaptable for use in pendulum length balancing of graphite shafted golf clubs. The present method is a more refined method for pendulum length balancing of golf clubs as compared to the method disclosed in Applicant's U.S. Pat. No. 5,608,160 and is more specifically designed for correcting swing deficiencies associated with the more skilled or professional golfer.

18 Claims, 2 Drawing Sheets

PENDULUM LENGTH BALANCING OF GOLF CLUBS INCLUDING GRAPHITE SHAFTED GOLF CLUBS

This application is a continuation-in-part application of U.S. patent application Ser. No. 08/627,740, filed Apr. 2, 1996, now U.S. Pat. No. 5,608,160.

The present invention relates to several methods for dynamically balancing golf clubs using equivalent pendulum length as the controlling parameter and, more particularly, discloses the use of several mathematical equations for calculating the equivalent pendulum length of any particular golf club, including graphite shafted golf clubs, without first determining the period of oscillation. Once the equivalent pendulum length of a particular golf club is determined, any particular group or set of clubs can be balanced to the same equivalent pendulum length. The present equations represent a more refined approach to pendulum length balancing as compared to the equation and method disclosed in U.S. Pat. No. 5,608,160 and is more particularly adapted for use in balancing graphite shafted golf clubs and in correcting the swinging deficiencies associated with the more skilled and professional golfer.

BACKGROUND OF THE INVENTION

As explained in Applicant's U.S. Pat. Nos. 5,094,101 and 5,608,160, a wide variety of methods for weighting and balancing golf clubs are known and have been utilized to some extent in an effort to improve the overall performance, control and handling characteristics of a particular set of golf clubs. Although Applicant's method for dynamically balancing golf clubs using radius of gyration as a controlling parameter as disclosed in U.S. Pat. No. 5,094,101 more accurately describes and simulates the dynamic characteristics associated with swinging a particular golf club and more accurately balances such golf clubs based upon dynamic as well as static characteristics, such method is somewhat more time consuming and tedious to achieve. In an effort to both simplify the overall balancing process and reduce the overall time involved in dynamically balancing golf clubs, Applicant devised the method disclosed in U.S. Pat. No. 5,608,160 for dynamically balancing golf clubs using equivalent pendulum length instead of radius of gyration as the controlling parameter. In this regard, Applicant devised a simple mathematical equation to accurately approximate the pendulum length of any particular golf club without first determining the period of oscillation, namely, $$EPL = \frac{Q + r}{2}$$

where

EPL=the equivalent pendulum length of any particular golf club;

Q=the shaft of center of percussion length of the club; and r=the distance between the axis of rotation and the center of gravity of the club.

As explained in U.S. Pat. No. 5,608,160, the use of this particular equivalent pendulum length equation avoids the tedious and time consuming method of empirically determining the period of oscillation of any particular golf club by actually timing the same as disclosed in both Elkins, Jr. U.S. Pat. No. 4,128,242 and Stuff et al U.S. Pat. No. 4,203,598. A detailed discussion of Applicant's derivation of this particular equivalent pendulum length equation is set forth in U.S. Pat. No. 5,608,160 and such discussion is incorporated herein by reference.

The equivalent pendulum length formula $$EPL = \frac{Q + r}{2}$$

was specifically derived to improve the overall performance, control and handling characteristics of any particular set of golf clubs used by the largest group of golfers playing the game today, namely, the beginning or high-handicapped golfer, senior golfers, golfers who play the game without ever having taken instruction as to how to properly swing any particular club, and other unskilled golfers. This particular group of golfers typically use arm and hand action during their swing to hit the ball and this results in reduced power, reduced ball accuracy, and swing inconsistency. The high-handicapped golfer therefore needs sufficient reduction in the pendulum length of each club to bring the radius of gyration values of most of his/her clubs closer together and this is accomplished by balancing the clubs of a high-handicapped golfer using Applicant's equivalent pendulum length formula $$EPL = \frac{Q + r}{2}$$

and the method disclosed in Applicant's U.S. Pat. No. 5,608,160. As fully explained in Applicant's U.S. Pat. No. 5,608,160, use of Applicant's equation $$EPL = \frac{Q + r}{2}$$

substantially results in a radius of gyration balancing of any particular group of clubs and this provides greatly improved performance, control and club handling characteristics for this particular group of golfers.

Mid-handicapped golfers, low-handicapped golfers and professional golfers likewise have some difficulties with their respective swinging motions but these golfers already utilize much better swinging techniques including better body control, and better hand, arm and shoulder coordination and action throughout a complete swinging motion. As a result, these golfers need substantially smaller reductions in the pendulum length of any particular club in order to improve their performance when using such club. Also, importantly, the more experienced and skilled golfers tend to use graphite shafted golf clubs as compared to the more conventional steel shafted clubs. Graphite shafted golf clubs are more difficult to use as the center of gravity and pendulum length of these clubs are longer because such clubs are substantially lighter and more flexible than the conventional steel shafted clubs. As a result, the pendulum length of a graphite shafted golf club cannot be reduced as much as a steel shafted golf club. This is true because since a graphite shafted club is typically lighter in weight than a comparable steel shafted club, this difference in weight affects the center of gravity location and the pendulum length of the club and, in fact, increases the center of gravity and pendulum length of the graphite shafted club. Since most of the weight associated with graphite shafted golf clubs are in the club head, the pendulum length of such clubs cannot be decreased as much when compared to a comparable steel shafted club. As a result, the equivalent pendulum length equation $$EPL = \frac{Q + r}{2}$$

does not always produce the desired result. Applicant has therefore devised several additional mathematical equations to better approximate the pendulum length of any particular golf club without first determining the period of oscillation, these additional mathematical equations being more particularly adaptable for use in balancing graphite shafted golf clubs, and in correcting the swinging deficiencies experienced by the more skilled or professional golfer. The use of Applicant's equivalent pendulum length equations provide custom balancing to correct the less obvious swinging deficiencies of the more skilled or professional golfer while still avoiding the tedious and time consuming method of empirically determining the period of oscillation of any particular golf club by actually timing the same as disclosed in the prior art references.

SUMMARY OF THE INVENTION

The present invention teaches the use of several mathematical equations for dynamically balancing a plurality of golf clubs such that the equivalent pendulum length for all such clubs comprising such plurality is held constant. As more fully explained in Applicant's U.S. Pat. No. 5,608,160, the present method is based upon the assumption that any particular golf club, when free to rotate and swing under the influence of gravity about a fixed horizontal axis not passing through the center of gravity of such club, will move and swing as a simple pendulum. As a result, since use of simple pendulum motion, with some modifications, sufficiently simulates the oscillating motion of a golf club for dynamic balancing purposes, a more simplified method for dynamically balancing a particular golf club using equivalent pendulum length as the controlling parameter has been devised for use with more skilled and professional golfers.

As explained in Applicant's U.S. Pat. No. 5,608,160, an ideal simple pendulum consists of a particle suspended by a weightless cord from an axis of rotation, the particle vibrating or swinging in a vertical arc under both the influence of gravity and the tension in the supporting cord. In such a situation, the particle or pendulum weight has a period of oscillation that depends only on the length of the cord. These ideal conditions are closely approximated by suspending a small heavy body 10 at the end of a light cord 12 from an axis of rotation 14 as illustrated in FIG. 1. In such an arrangement, the weight or body positions B and C represent respective positions of the body 10 along the arc of travel AD. The period or time required for a complete oscillation from A to D and back to A again is represented by the equation $$T = 2\pi\sqrt{\frac{l}{g}} \quad (1)$$

where

T=period or time required for a complete oscillation;

l=pendulum length measured from the axis of rotation to the center of gravity of the weight of the body; and g=the gravitational constant (i.e., 32.2 ft/sec$^2$ or 386.4 in/sec$^2$).

As shown in FIG. 1, in this particular simulation, the center of gravity, radius of gyration and the center of percussion of the weight or body 10 are all co-located at the same physical location. As a result, the pendulum length l is measured from the axis of rotation 14 to the center of gravity of the weight 10 as illustrated in FIG. 1. Since the period or time of oscillation defined in Equation 1 above is dependent solely upon the pendulum length l, once such pendulum length is known, the period of oscillation for a particular body such as the body 10 illustrated in FIG. 1 can be easily calculated.

The pendulum simulation illustrated in FIG. 1 does not completely accurately describe the dynamic characteristics associated with swinging a particular golf club because the shaft associated with any particular golf club is not accurately represented by the weightless cord 12 illustrated in FIG. 1. The shaft of any particular golf club has some weight associated with it which creates a center of gravity of the overall club which in turn makes the period of oscillation faster and the pendulum length of the club shorter than the overall shaft length as compared to the pendulum length associated with the ideal simple pendulum illustrated in FIG. 1. As a result, the weight of the golf club shaft must be taken into account in order to more accurately determine the pendulum length associated with any particular club.

If the body weight 10 illustrated in FIG. 1 is divided as illustrated in FIG. 2 into a main body weight 16 and a smaller or fractional weight 18, as the smaller fractional weight 18 is moved upwardly along the weightless cord 12, the overall center of gravity and radius of gyration of the combined bodies 16 and 18 will likewise move upwardly along cord 12. This results in a faster period of oscillation since the overall pendulum length of the weight combination 16 and 18 is shorter than the pendulum length associated with body weight 10 illustrated in FIG. 1. This means that the pendulum length of the weight combination 16 and 18 lies somewhere between the center of gravity of the main weight 16 and the center of gravity of the partial weight 18 as illustrated in FIG. 2. It has also been observed that as the partial weight 18 is increased in overall weight, or such weight 18 is moved even further upwardly along weightless cord 12, or if both of these conditions occur, the pendulum length of the weight combination 16 and 18 becomes even shorter. This reinforces the observation and hypothesis that the pendulum length of the weight combination 16 and 18 as illustrated in FIG. 2 will lie somewhere between the respective weights.

The pendulum model illustrated in FIG. 2 can be used as a stepping stone to approximate the simple pendulum motion of any particular golf club swing such as the golf club 20 illustrated in FIG. 3 wherein the main body weight 16 of FIG. 2 represents the weight of the club head 22 and the partial body weight 18 of FIG. 2 represents the weight of the club shaft 24. As the weight of the cord 12 (FIGS. 1 and 2) is increased and gradually changed to an extremely lightweight club shaft, such as a graphite club shaft, the center of gravity of the overall club is pulled upward on the club head 22 unto the hosel and as the weight of the club shaft and grip is further increased, the center of gravity of the club will move further upward towards the axis 14. In FIG. 1, the pendulum length is the length of the cord 12 to the center of gravity of the weight 10. In FIG. 2, the pendulum length is the length of the cord 12 to some point on such cord which lies between the respective weights 16 and 18. In FIG. 3, it has been observed that the pendulum length of the overall club 20 lies somewhere between the center of gravity of the club head 22 and the center of gravity of the overall club 20. As explained and discussed in Applicant's U.S. Pat. Nos. 5,094,101 and 5,608,160, and as illustrated in FIG. 3, the distance r represents the distance from the axis of rotation 14 located at the terminal end portion of the shaft or grip to the center of gravity location of the overall club and the distance Q represents the center of percussion length of the club measured from the axis of rotation 14 to the center of percussion of the club head 22. Since the center of gravity of the club head 22 coincides with or typically lies substantially close to the center of percussion of the club head, the center of percussion length Q can be used to closely approximate the distance from the axis of rotation 14 to the center of gravity of the club head 22. Since it is has been observed that the pendulum length of the overall club 20 lies somewhere between the center of gravity of the overall club and the center of gravity of the club head 22, and since both the center of gravity length r and the center of percussion length Q can be easily determined for any particular club, Applicant postulates that the equivalent pendulum length of any particular golf club can be determined by any one of the following formulas, $$EPL = \frac{2Q + r}{3} \tag{2}$$

where

EPL=the equivalent pendulum length of any particular golf club;

Q=the shaft or center of percussion length of the club; and r=the distance between the axis of rotation and the center of gravity of the club;

$$EPL = \frac{Q + K}{2} \tag{3}$$

where

EPL=the equivalent pendulum length of any particular golf club;

Q=the shaft or center of percussion length of the club; and

K=the radius of gyration of the club;

$$EPL = \sqrt{Q \times K} \tag{4}$$

where

EPL=the equivalent pendulum length of any particular golf club;

Q=the shaft or center of percussion length of the club; and

K=the radius of gyration of the club.

It is important to note that two of the three above-identified equivalent pendulum length equations utilize the radius of gyration K of the particular club as part of the equation. As a result, use of these equations will involve the extra step of finding the radius of gyration K of the particular club. This can be accomplished by using the radius of gyration formula $K^2=Q\times r$ or $K=\sqrt{Q\times r}$, where the terms Q and r are as defined above. Based upon the above assumptions and use of any one of the equations (2), (3) or (4), any one of these equations will locate the pendulum length of a particular club somewhere between the center of gravity location of the entire club 20 and the center of percussion length for such club. These approximations are more refined for the purposes of the present method as compared to the method and use of the equation $$EPL = \frac{Q + r}{2}$$

disclosed in U.S. Pat. No. 5,608,160 primarily because the radius of gyration of all of the clubs balanced in accordance with any one of equations (2), (3) or (4) will not remain substantially constant as is true when using the equation $$EPL = \frac{Q + r}{2}$$

as demonstrated in Applicant's U.S. Pat. No. 5,608,160. In other words, the equivalent pendulum length balancing accomplished by using any one of the present equations equations (2), (3) or (4) is not a radius of gyration balancing as was true in the case of equivalent pendulum length balancing using Applicant's previously derived equation $$EPL = \frac{Q + r}{2}.$$

Once the equivalent pendulum length for a favorite or reference club has been calculated, other clubs in a particular set or grouping can be balanced to the same equivalent pendulum length by calculating a new anticipated center of gravity associated with each of the other clubs in such grouping based upon the selected equivalent pendulum length value. Once the new center of gravity locations are calculated by utilizing any one of equations equations (2), (3) or (4) above, each club can be weighted and balanced about its new center of gravity location thereby producing a set or group of golf clubs weighted and balanced to the same equivalent pendulum length. It is also possible to balance a single club to a new equivalent pendulum length based upon any one of the above-identified equations as will be hereinafter further explained.

The present method for balancing any particular golf club or group of golf clubs based upon a constant equivalent pendulum length comprises the following steps:

(1) having a golfer select a reference club having all of the optimal parameters and optimal performance characteristics for that particular golfer as set forth and explained in Applicant's U.S. Pat. No. 5,094,101;

(2) through measuring and balancing, obtaining the shaft or center of percussion length, and the center of gravity location of the reference club as explained in U.S. Pat. No. 5,094,101;

(3) if necessary, calculate the radius of gyration of the reference club using the equation $K=\sqrt{Q\times r}$;

(4) using any one of the equivalent pendulum length equations equations (2), (3) or (4) identified above, calculate the equivalent pendulum length for the reference club;

(5) determining the shaft or center of percussion length of each club to be balanced to the equivalent pendulum length of the reference club;

(6) using the same equivalent pendulum length equation selected in step (4) above, calculate the new center of gravity location for each club to be balanced based upon the selected equivalent pendulum length of the reference club; and (7) balancing each such golf club to be balanced in a conventional manner at its new center of gravity location based upon the selected equivalent pendulum length.

Since the period or time of oscillation represented by equation 1 is dependent solely upon the pendulum length, and substituting equivalent pendulum length for pendulum length, equation 1 above becomes as follows:

$$T = 2\pi\sqrt{\frac{EPL}{g}} \quad (5)$$

Since each club in the particular group of clubs to be balanced is in fact balanced at its new center of gravity location based upon the equivalent pendulum length of the referenced club, the period of oscillation of each such club balanced in accordance with the present method will likewise be the same. As a result, the present method likewise automatically balances all such clubs to a common period of oscillation.

As explained in Applicant's U.S. Pat. No. 5,608,160, the importance of the present invention lies in the fact that once a particular equivalent pendulum length is selected, the dynamic equations for simple pendulum length are used to correlate the center of percussion length of each respective club to the new center of gravity location based upon the selected equivalent pendulum length value. Applicant's approach to determining the equivalent pendulum length (EPL) of any particular club as evidenced by equations equations (2), (3) or (4) above, and to matching a group of clubs to a particular common pendulum length is much fastener than the empirical method of trying to match the periods of oscillation of two or more clubs as discussed above and as disclosed in the prior art. Modifying or balancing any one or more clubs to the same equivalent pendulum length of a preferred or reference club will make all such clubs swing and feel alike.

It is therefore a principal object of the present invention to provide another method for dynamically balancing any plurality of golf clubs wherein a common equivalent pendulum length is used as the controlling parameter.

Another object is to provide a simpler, less time consuming method for dynamically balancing golf clubs using a common equivalent pendulum length as the controlling parameter as compared to the method disclosed in U.S. Pat. No. 5,094,101.

Another object is to teach several mathematical formulas for closely approximating the equivalent pendulum length of any particular golf club.

Another object is to teach a method for dynamically balancing any plurality of golf clubs wherein some of said plurality of golf clubs are balanced to one specific equivalent pendulum length value, while other clubs in said plurality are balanced to another specific equivalent pendulum length value.

Another object is to provide a method for optimizing and improving the overall feel, swing and performance characteristics of a particular set or group of golf clubs, particularly golf clubs used by more skillful or professional golfers.

Another object is to provide a method for dynamically balancing any golf club so as to more accurately match the individual clubs in a particular set or grouping so that all such clubs "swing" or "feel" alike.

Another object is to provide a method for balancing graphite shafted golf clubs to a common equivalent pendulum length.

These and other objects and advantages of the present invention will become apparent to those skilled in the art after considering the following detailed specification in conjunction with the accompanying drawings.

DETAILED DESCRIPTION OF THE INVENTION

Figure 3:
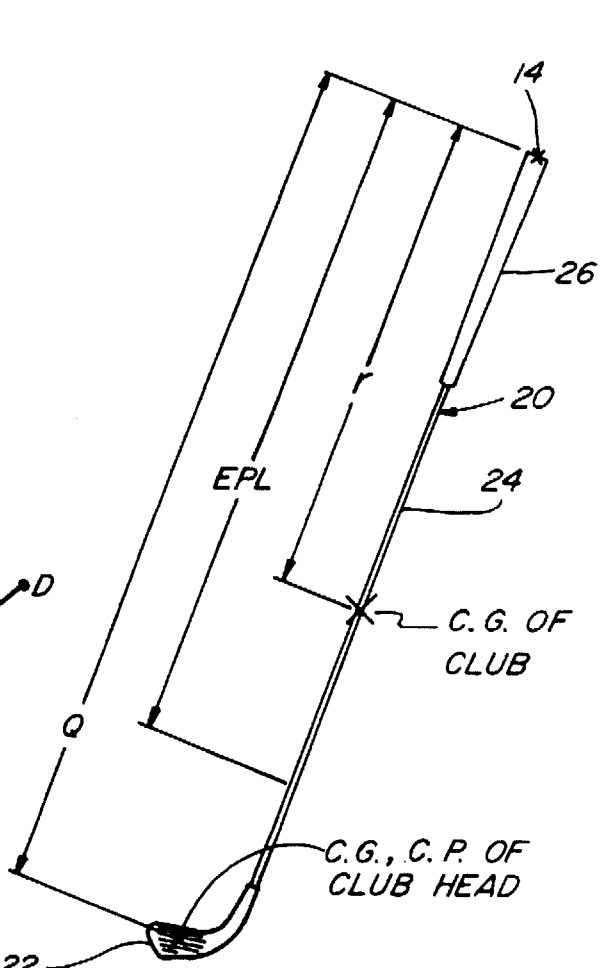
FIG. 3 is an illustration of a typical golf club suspended for simple pendulum motion from an axis of rotation wherein the location of the various parameters used in the present method for dynamically balancing a particular golf club are identified and illustrated therein.

The first step in the present method for dynamically balancing any particular plurality of golf clubs again involves having a golfer select a favorite or reference club having all of the optimal design parameters and performance characteristics important to that particular golfer as previously explained in Applicant's U.S. Pat. No. 5,094,101. This selection of an ideal reference club involves a subjective evaluation on the part of the golfer in determining what performance and handling characteristics are important to that particular golfer, and what particular club construction "feels" and "performs" best for that golfer. The selected reference club should take into account all of the preferred factors and characteristics important to that golfer including such parameters as the overall weight of the club, moment of inertia, center of percussion location, center of gravity location, preferred or optimal club length, the particular grip style and configuration preferred, and, most importantly, the ease, feel and comfortability with respect to swinging the reference club as well as its performance and control. Regardless of which club is selected as the reference club, it is important to remember that the above-referenced parameters with respect to the reference club are critical to the present balancing method since the reference club establishes the equivalent pendulum length value for the remaining clubs to be balanced and such equivalent pendulum length is a critical factor in how a club feels and performs.

In selecting the reference club, it is important to note that if graphite shafted golf clubs are being balanced, we cannot balance all of the graphite shafted clubs in a particular set of clubs to the same equivalent pendulum length because we cannot reduce the pendulum length of the longer graphite shafted clubs a sufficient amount in order to achieve this goal. In this particular situation, the golfer may select a preferred wood and a preferred iron as reference clubs and some or all of the irons in a particular set of clubs could be weighted and balanced to the specific equivalent pendulum length of the referenced iron club and some or all of the woods in the same set of golf clubs could be weighted and balanced to a different equivalent pendulum length based upon the referenced wood club. Other groupings of selected clubs out of a particular set of graphite shafted golf clubs could likewise be balanced to specific equivalent pendulum length values, as desired. In other words, when using graphite shafted golf clubs, we will not necessarily be able to balance some or all of the woods in a particular set of graphite shafted golf clubs to a selected referenced iron club, nor will we necessarily be able to balance some or all of the irons in a particular set of graphite shafted golf clubs to a selected referenced wood club. This is typically not a problem since the more skilled or professional golfer is normally only concerned with improving his/her swinging motion with respect to the driver, the three wood, and the lower numbered irons such as the one, two, three and four irons. The objective here is to balance a particular club to a reduced equivalent pendulum length (EPL) so as to make that particular club swing better and use of any one of the above-identified equations equations (2), (3) or (4) will achieve this objective, even when balancing graphite shafted golf clubs.

Figure 4:
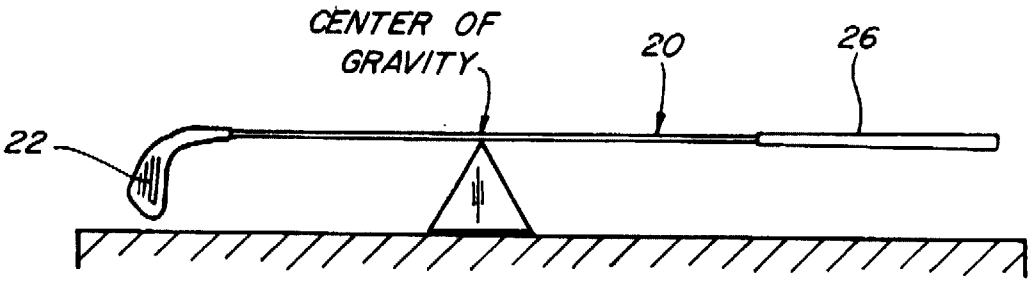
FIG. 4 is a side elevational view of a typical fulcrum device used to locate the center of gravity of a golf club along the shaft thereof.

Once the reference club has been selected in accordance with the guidelines set forth above and in U.S. Pat. No. 5,094,101, the reference club, such as the club 20 illustrated in FIGS. 3 and 4, is measured to determine its shaft or center of percussion length. As illustrated in FIG. 3, the shaft or center of percussion length is measured from the free end of the grip portion 26 to the center of percussion of the club head 22. If the location of the center of percussion of the reference club is not already known, such location must be determined by known means. The location of the center of percussion of any particular golf club can be determined as more fully explained in Applicant's U.S. Pat. No. 5,277,059. When the face of the club head 22 is struck such that the only motion imparted to the club head 22 is rotational or straight back motion, this location corresponds to the center of percussion for the selected golf club as explained in U.S. Pat. No. 5,277,059. Once the shaft or center of percussion length Q has been determined, the reference club 20 is balanced on a conventional fulcrum type device as illustrated in FIG. 4 in order to locate the center of gravity position for such club. When so balanced, the center of gravity location is marked on the club shaft and the distance r (FIG. 3) from the center of gravity location to the free end portion of the grip 26 is measured and determined. With respect to the selected reference club 20, we now know the shaft or center of percussion length Q and the distance r as illustrated in FIG. 3.

Once the shaft or center of percussion length Q and the distance r of the selected reference club 20 is obtained, one of the three above-identified equivalent pendulum length equations, namely, equation equations (2), (3) or (4), must be selected and used as the basis for balancing all of the remaining clubs to be balanced. The selection of one of the three equivalent pendulum length equations involves a subjective evaluation on the part of the golfer and may include a trial and error process wherein one club is balanced with each of the three different equations in order to determine which equation produces the best performance and handling characteristics for that particular golfer. For illustrative purposes, we will describe the present balancing method using each of the three derived equivalent pendulum length equations.

Using, first, the equivalent pendulum equation (2), namely, $$EPL = \frac{2Q + r}{3},$$

the equivalent pendulum length can now be calculated for the selected reference club 20. Having determined the equivalent pendulum length for the selected reference club, this equivalent pendulum length value will now be the basis for balancing any plurality of the remaining clubs in any particular set or other club grouping. The remaining club or clubs to be balanced can now be assembled and the shaft or center of percussion length associated with each such club is measured as previously described with respect to reference club 20. This now establishes the shaft or center of percussion length Q for each club in any particular plurality of clubs to be balanced. Again, using the equivalent pendulum length equation (2) as set forth above, the distance r representing the distance between the free end portion of the club shaft and the new anticipated center of gravity of the club based upon the selected equivalent pendulum length value determined for the reference club can now be calculated for each club to be balanced. Each such distance r represents the new center of gravity location associated with each of the respective clubs about which location each such club will now be balanced in order to produce a plurality of clubs each having an equivalent pendulum length equal to the equivalent pendulum length determined for the reference club 20.

Figure 5:
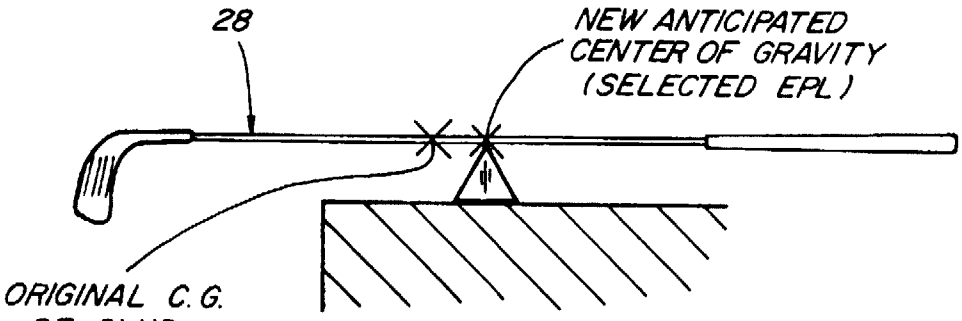
FIG. 5 is a side elevational view of a typical fulcrum device similar to FIG. 4 illustrating the weighting and balancing of a particular golf club at its new center of gravity location based upon a selected equivalent length value.
Figure 2:
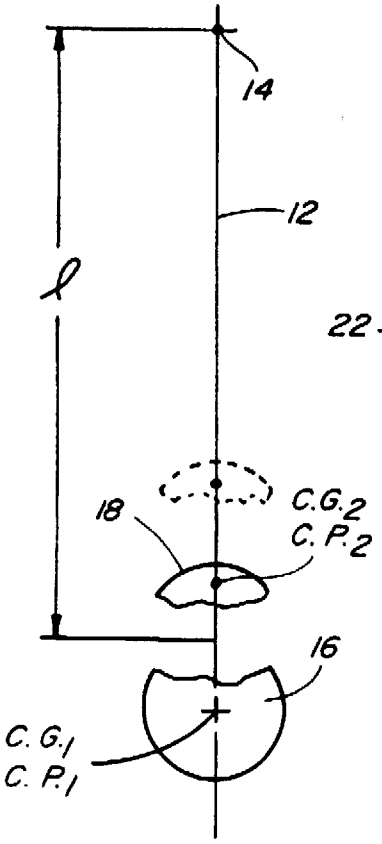
FIG. 2 is a depiction of a simple pendulum arrangement illustrating movement of the pendulum length as weight is attributed to or moved upwardly along the cord member.

Each club to be balanced in accordance with the present method such as the golf club 28 shown in FIG. 5 is now balanced in a conventional manner at its new center of gravity location as calculated above and as illustrated in FIG. 5. This balancing is achieved as previously discussed in Applicant's U.S. Pat. No. 5,094,101 by generally adding trial weights adjacent the grip end portion of the club in order to balance such club in equilibrium about the new center of gravity location. If the particular club being balanced to the selected equivalent pendulum length value is, in fact, being balanced without the grip member attached thereto, a substitute weight simulating the weight of the grip member is positioned on the club shaft at the approximate location prior to balancing as explained in U.S. Pat. No. 5,094,101. Once the club is balanced as just described, a single permanent weight equal to the trial weight or any equivalent weight arrangement is positioned and secured preferably inside the club shaft at the same location as the trial weight as fully set forth and explained in Applicant's U.S. Pat. No. 5,094,101. The trial weight is then removed and the balance of the club with the permanent weight or weights secured thereto is then rechecked to ensure that the club has remained in balance. If, for any reason, the club remains out of balance when the permanent weights are attached thereto, the above-identified balancing process is repeated until complete balancing and equilibrium is achieved. At this point, the club is dynamically balanced to the same equivalent pendulum length of the reference club. If a simulated grip weight was used during the balancing process as explained in U.S. Pat. No. 5,094,101, the simulated weight can now be removed and the actual grip member is positioned and secured to the outer periphery of the club shaft. Again, once the grip member is attached to the club, the balance of the club should again be rechecked and, if necessary, re-balanced. Since the equivalent pendulum length was held constant, the re-balanced club now has the same desired, optimal performance and feel as the reference club.

If, for example, equivalent pendulum length equation (3), namely, $$EPL = \frac{Q + K}{2},$$

is selected as the controlling equation, the equivalent pendulum length of the reference club 20 can be calculated as follows. Using the radius of gyration equation $K^2=Q\times r$, we know that $K=\sqrt{Q\times r}$. As a result, equivalent pendulum length equation (3) can be rewritten as follows:

$$EPL=\frac{Q+K}{2}=\frac{Q+\sqrt{Q\times r}}{2}. \quad (6)$$

Since we know the shaft or center of percussion length Q and the distance r of the reference club 20, the equivalent pendulum length for the selected reference club can now be determined using equation (6) above. This equivalent pendulum length value will now be the basis for balancing any plurality of the remaining clubs in any particular set or other club grouping as previously described above with respect to equivalent pendulum length equation (2). The remaining club or clubs to be balanced can now be assembled and the shaft or center of percussion length associated with each such club is measured as previously described above. This now establishes the shaft or center of percussion length Q for each club in any particular plurality of clubs to be balanced. Again, using equivalent pendulum length equation (3) above as modified in equation (6), the distance r representing the distance between the free end portion of the club shaft and the new anticipated center of gravity of the club based upon the selected equivalent pendulum length value determined for the reference club can now be calculated for each club to be balanced. Each such distance r represents the new center of gravity location associated with each of the respective clubs about which location each such club will now be balanced as previously described in order to produce a plurality of clubs each having an equivalent pendulum length equal to the equivalent pendulum length determined for the reference club 20.

Similarly, if equivalent pendulum length equation (4), namely, $EPL=\sqrt{Q\times K}$, is selected as the controlling equation for completing the present balancing process, the equivalent pendulum length of the reference club 20 can be calculated as follows. Again, substituting $K=\sqrt{Q\times r}$ into equivalent pendulum length equation (4), such equation can be modified as follows:

$$EPL=\sqrt{Q\times K}=\sqrt{Q\times\sqrt{Q\times r}}. \quad (7)$$

Since the parameters Q and r are known for the selected reference club 20, the equivalent pendulum length for the reference club 20 can now be calculated. Having determined the equivalent pendulum length for the selected reference club, this equivalent pendulum length value will now be used as the basis for balancing any plurality of the remaining clubs in any particular set or other club grouping as previously described above with respect to equivalent pendulum length equations (2) and (3).

Although the above method has been described with respect to a particular club 28, the present balancing method can be successively repeated for each club to be balanced in accordance with the techniques and teachings described above. When each individual club to be balanced has, in fact, been balanced about the new anticipated center of gravity location based upon the selected equivalent pendulum length value, each such club will be dynamically balanced to the same equivalent pendulum length. As previously explained, it is also recognized and anticipated that some or all of the irons associated with a particular set of golf clubs could be dynamically balanced to one equivalent pendulum length value whereas some or all of the woods associated with the same set of clubs could be balanced to a different equivalent pendulum length value, the reference club selected for the woods exhibiting different performance and feel characteristics as compared to the reference club selected for the irons. Still further, some of the irons may be balanced to one equivalent pendulum length value whereas other irons in the same set may be balanced to a different equivalent pendulum length value. In this regard, typically, it is not necessary to balance the higher irons such as the 7, 8 and 9 irons as well as the pitching wedge type clubs in accordance with the present method since these clubs are generally easier to swing and generally have equivalent pendulum lengths substantially close to the selected reference club. Nevertheless, depending upon the particular performance characteristics preferred by the individual golfer, any plurality of golf clubs can be balanced in accordance with the present method including the higher numbered irons and pitching type wedge clubs.

Also, although, in most cases, the club to be balanced such as club 28 illustrated in FIG. 5 will be weighted towards the grip portion of the club, it is further recognized and anticipated that, in some cases, depending upon the characteristics of the reference club selected by a particular golfer, additional weights may have to be added towards the club head portion of the club in order to bring such club into balance about the new anticipated center of gravity location. In such event, the permanent weights needed to bring such club into balance will have to be manipulated and located at the proper position on the club head in a manner that will retain the center of percussion at the center of the club face or at some other location previously selected.

For comparison purposes, a typical 43 inch steel shafted driver was measured and balanced on a conventional fulcrum type device as illustrated in FIG. 4 in order to determine its shaft or center of percussion length and to locate its center of gravity location. When so measured and balanced, the following was obtained:

Q=43 inches (shaft or center of percussion length)

r=30 inches (distance between axis of rotation and the center of gravity of the club)

Using these values, the radius of gyration of this particular club was calculated using the following formula:

$$K^2=Q\times r \text{ or } K=\sqrt{Q\times r}$$

where

K=the radius of gyration of the club,

Q=the shaft or center of percussion length of the club, and r=the distance between the axis of rotation and the center of gravity of the club.

Using the Q and r values determined above, the radius of gyration of this 43 inch steel shafted driver was calculated to be as follows:

$$K=\sqrt{43\times 30}=\sqrt{1290}=35.92 \text{ inches}$$

Using the Q, K, and r values determined above for the 43 inch steel shafted driver, the equivalent pendulum length for such club calculated using all three of the above-identified equivalent pendulum length equations yields the following:

$$EPL=\frac{2Q+r}{3}=\frac{2(43)+30}{3}=\frac{116}{3}=38.67 \text{ inches} \quad \text{(Equation 2)}$$

$$EPL=\frac{Q+K}{2}=\frac{43+35.92}{2}=\frac{78.92}{2}=39.46 \text{ inches} \quad \text{(Equation 3)}$$

$$EPL=\sqrt{Q\times K}=\sqrt{43\times 35.92}=\sqrt{1544.56}=39.3 \text{ inches} \quad \text{(Equation 4)}$$

A comparison of the equivalent pendulum length (EPL) values calculated for the same club using all three of the present equivalent pendulum length equations disclosed herein reveals that although the equivalent pendulum length value calculated from each of such equations are substantially close to each other ranging from 38.67 inches to 39.46 inches, there is still sufficient difference between the EPL values calculated from each of the respective EPL equations such that use of any one of these EPL equations as the controlling equation in the present balancing method will yield a slightly different balanced group of clubs when compared one to the other. This means that a particular group of clubs can be custom balanced to meet the particular needs of a particular golfer based upon that golfer's particular swinging motion.

It is also important to note that although use of any one of the three above-identified equivalent pendulum length equations, namely, equations (2), (3) and (4), will produce slightly different reductions in equivalent pendulum length, such reductions are not as great as that obtained when using the equivalent pendulum length equation disclosed in Applicant's U.S. Pat. No. 5,608,160, namely, $$EPL=\frac{Q+r}{2}.$$

Using this latter equation, the equivalent pendulum length of the same 43 inch steel shafted driver referenced above is as follows:

$$EPL=\frac{Q+r}{2}=\frac{43+30}{2}=\frac{73}{2}=36.5\text{ inches.}$$

This equivalent pendulum length value of 36.5 inches is substantially shorter than the three equivalent pendulum length values derived from equations (2), (3) and (4) and, as such, evidences a much greater reduction in overall pendulum length for a particular club which, in turn, will greatly affect the feel and swing of such club when balanced in accordance with the method disclosed in U.S. Pat. No. 5,608,160.

It may also be possible that none of the clubs in any particular plurality of golf clubs exhibit the performance and handling characteristics desired by a particular golfer and, therefore, no reference club is immediately apparent. In this particular situation, the present method of equivalent pendulum length balancing can likewise be used to balance a single golf club to an equivalent pendulum length value which corresponds to the best handling characteristics of that club for that particular golfer. This can be accomplished by trial and error wherein a golfer selects a particular golf club, such as a driver, and thereafter adds trial weights adjacent the grip end portion of such club until such club exhibits performance, swing and feel characteristics satisfactory to that particular golfer. Once this is accomplished, the equivalent pendulum length is established for that particular club and such equivalent pendulum length can now be calculated as described above using any one of the three above-identified equivalent pendulum length equations, namely, equations (2), (3) and (4). Any remaining clubs to be balanced can now be assembled and balanced to this same equivalent pendulum length value as previously described.

Figure 1:
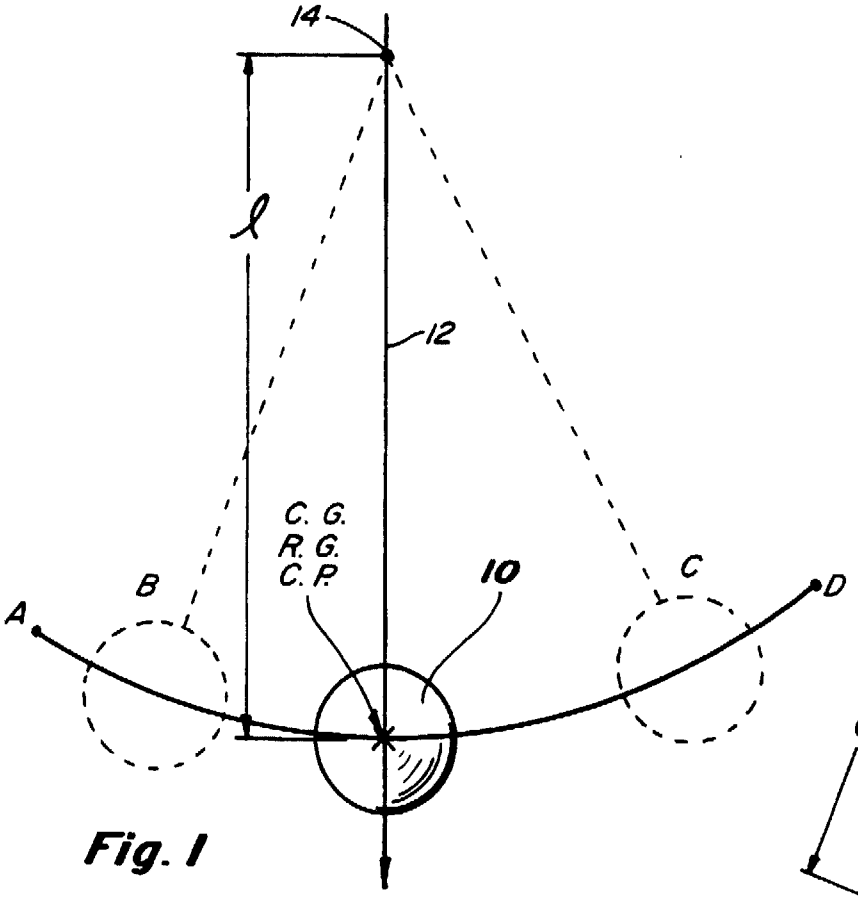
FIG. 1 illustrates the arrangement of a simple pendulum wherein the pendulum weight is suspended for arcuate motion at the end of a substantially weightless cord.

Equivalent pendulum length equations (2), (3) and (4) are likewise particularly adaptable for use in balancing graphite shafted golf clubs. This is true because graphite shafts are extremely lightweight and graphite shafted golf clubs, when free to rotate and swing under the influence of gravity about a fixed horizontal axis not passing through the center of gravity of such club, will move and swing very close to the simple pendulum simulation illustrated in FIG. 1. A graphite shafted club is so much lighter than a comparable steel shafted club that practically all of the club weight is concentrated in the club head. As a result, the center of gravity length r and the equivalent pendulum length value of a graphite shafted golf club are much longer or greater as compared to the center of gravity length and EPL value of a similarly constructed steel shafted club. As a result, when weight is added at the grip end of a graphite shafted golf club, the center of gravity length r as well as the EPL value associated with such club is reduced by a much smaller amount as compared to the shift in center of gravity length and EPL value of a comparable steel shafted club. These smaller reductions in both center of gravity length and EPL value are more accurately reflected in the use of any one of equivalent pendulum length equations (2), (3) or (4), as compared to using the equivalent pendulum length equation $$EPL=\frac{Q+r}{2}$$

previously disclosed in Applicant's U.S. Pat. No. 5,608,160. A comparison of the EPL values calculated for a 43 inch steel shafted driver using all of Applicant's four different pendulum length equations substantiates this fact. Although a steel shafted driver was utilized for this comparison, use of a graphite shafted driver would yield a similar comparison, namely, the shift of EPL values is greater using the equation $$EPL=\frac{Q+r}{2}$$

as compared to the more refined shift in EPL values when using equations (2), (3) or (4) of the present invention. This means that use of any one of the equivalent pendulum length equations (2), (3) or (4) of the present method for balancing golf clubs will produce smaller reductions in equivalent pendulum length.

Since most of the weight of graphite shafted golf clubs lie in the club head, the center of gravity of such clubs will be closer to the club head as compared to steel shafted golf clubs and therefore smaller changes in both the center of gravity length r as well as the equivalent pendulum length EPL of such clubs will produce a better feeling and performing club. Also, importantly, the weight added at the grip end of a graphite shafted golf club which reduces the center of gravity and pendulum length of such club is limited to an amount that reduces the center of gravity length to a point on the club shaft which is approximately 1 inch below the halfway length of such club. Any further reduction in the center of gravity length will change the $K^2/r$ ratio and will pull the center of percussion location upwards towards the grip end. Since the center of percussion length $Q=K^2/r$, holding the ratio $K^2/r$ substantially constant will likewise hold the center of percussion length at or near its desired location on the club head. See Applicant's U.S. Pat. No. 5,277,059 for a more detailed discussion of the $K^2/r$ ratio. This produces a more comfortable feel during use as compared to the greater changes in both center of gravity length r and equivalent pendulum length EPL produced by the equivalent pendulum length equation disclosed in Applicant's U.S. Pat. No. 5,608,160.

It is also important to recognize that once a particular plurality of golf clubs are balanced in accordance with the present method using any one of the three above-identified equivalent pendulum length equations as the controlling EPL parameter, such re-balanced group or set of golf clubs can be utilized as a particular master or reference set of golf clubs and all such clubs can be placed on a conventional swing weight scale so as to determine the corresponding swing weight scale designation associated with each of the re-balanced clubs in the master set. Once this correlation between equivalent pendulum length value and swing weight scale designation has been established, an identical set of golf clubs could be swing weighted to the same identical swing weight scale designations associated with the master or reference set of golf clubs in accordance with the teachings set forth in Applicant's correlated swing weight method for dynamically balancing golf clubs as taught in U.S. Pat. No. 5,417,108. This assumes that each golf club in the particular set of golf clubs to be balanced is substantially identical in weight, length and weight distribution as compared to the corresponding master set. Such a balancing would theoretically produce a set or plurality of golf clubs dynamically balanced to the same equivalent pendulum length by balancing such golf clubs on a conventional swing weight scale device to their respective corresponding, correlated equivalent pendulum length/swing weight scale designation reading as taught in Applicant's U.S. Pat. No. 5,417,108. Therefore, instead of tediously calculating the new center of gravity location for each of the remaining clubs to be balanced in any particular set or grouping of clubs and thereafter tediously balancing each of such remaining clubs on a conventional fulcrum device about their respective new center of gravity locations as illustrated in FIG. 5, the equivalent pendulum length/swing weight scale correlation method described above and as more fully explained in Applicant's U.S. Pat. No. 5,417,108 circumvents this more tedious and time consuming method for dynamically balancing golf clubs and enables one to even further simplify the equivalent pendulum length balancing process by balancing any remaining identical sets or pluralities of golf clubs to be balanced on a swing weight scale using the correlation just determined between the selected equivalent pendulum length value and the corresponding or correlated swing weight scale designation or reading for a master set of clubs.

Since the present method also allows one to keep track of the additional balance weight which must be added to the grip side of each club to be balanced in order to balance each such club to the selected equivalent pendulum length value, a correlation also exists between the selected equivalent pendulum length value and the amount of additional weight which must be added to the particular clubs to be balanced in order to dynamically balance such clubs to the selected equivalent pendulum length value. This correlation can be obtained for a particular master or reference plurality of golf clubs. Once this correlation between equivalent pendulum length value and additional balance weight has been established, an identical plurality of golf clubs could be balanced to the selected equivalent pendulum length value by adding the corresponding/correlated additional balance weight to the grip side of the particular club to be balanced. This assumes that each golf club in the particular plurality of golf clubs to be balanced is again substantially identical in weight, length and weight distribution as compared to the corresponding master set or plurality of clubs. Such a balancing would again theoretically produce a set or plurality of golf clubs wherein, when each such club is thereafter positioned on a fulcrum, each such club will be balanced at the new anticipated center of gravity length r previously determined for the corresponding club in the master or reference set of clubs. This correlated balancing method based upon adding weight to the grip side of each of the plurality of golf clubs to be balanced is likewise discussed and more fully explained in Applicant's U.S. Pat. No. 5,417,108.

Although a precise relationship between a swing weight scale designation, additional balance weight and a particular equivalent pendulum length value can be established for a particular plurality of golf clubs that are identical in length, weight and weight distribution, realistically, very few sets of golf clubs are identical to each other in length, weight and weight distribution and this inaccuracy will be reflected in varying swing weight scale readings and differences in equivalent pendulum length values. This is true in all of the known weighting and balancing techniques as well as in the present method of dynamically balancing golf clubs using equivalent pendulum length as a controlling parameter. Nevertheless, as indicated above, the present method is sufficiently accurate as compared to other known prior art balancing methods and teaches a more simplified method for accomplishing the stated objectives.

It is also important to recognize that changing the weight of the various components which comprise any particular golf club such as the club head, the shaft and the club grip, likewise affects the EPL of the club. Also, changing the length of the club shaft will affect the EPL of such club. As a result, golf clubs can be either modified or designed to a reduced EPL with decreased center of gravity and radius of gyration values simply by changing or substituting the various component parts associated with any particular golf club with other differently weighted components. Any one or all of the following component changes, whether or not a balance weight is utilized at the grip end of the club, will affect a change in the EPL of such club. For example, decreasing the weight of the club head and/or increasing the weight of the club shaft by replacing such components with new components will reduce the EPL of the club. If both such changes are accomplished, namely, both decreasing the weight of the club head and increasing the weight of the club shaft, an even further reduction in the EPL value of such club will be obtained. Designing the club shaft with thicker steel on the grip side of the shaft likewise reduces the EPL even more because of the added weight to the shaft on the grip side. Still further, increasing the weight of the club grip will likewise decrease the EPL of the club. Reductions in the overall EPL of a club can likewise be obtained by decreasing the overall club length.

In similar fashion, if it is desirable to increase the overall EPL of a shorter club such as the 7, 8, 9 and/or pitching wedge type clubs, this can likewise be accomplished by changing the component parts of such clubs such as by increasing the weight of the club head, and/or using a lighter weight club shaft, and/or using a longer club shaft, and/or using a lighter weight club grip. In any event, any change in the conventional weight of a club head, club shaft, club grip, and/or distribution of the weight in a particular golf club that reduces the EPL of such club is considered to be within the spirit and scope of the present invention.

Thus, there has been shown and described several novel methods for dynamically balancing golf clubs to both a common period of oscillation and a common equivalent pendulum length, which methods fulfill all of the objects and advantages sought therefor. Many changes, modifications, variations, and other uses and applications of the present invention will, however, become apparent to those skilled in the art after considering this specification and the accompanying drawings. All such changes, modifications, variations, and other uses and applications which do not depart from the spirit and scope of the invention are deemed to be covered by the invention which is limited only by the claims which follow.

What is claimed is:

1. A method for balancing a plurality of golf clubs wherein each of said plurality of clubs are balanced to the same equivalent pendulum length, said method comprising the following steps:

(a) selecting a predetermined equivalent pendulum length value;

(b) determining the shaft or center of percussion length of each club in said plurality of clubs;

(c) using the equation $$EPL = \frac{2Q + r}{3}$$

where

EPL=the equivalent pendulum length of the club,

Q=the shaft or center of percussion length of the club, and r=the distance from the center of gravity of the club to the grip end, calculating the new anticipated center of gravity length r for each club in said plurality of clubs based upon the corresponding shaft or center of percussion length Q associated respectively therewith and the selected equivalent pendulum length value EPL; and (d) balancing each of said plurality of clubs at its respective new anticipated center of gravity location.

2. The method defined in claim 1 further comprising the following additional steps:

(a) placing each of said plurality of clubs balanced in accordance with the method set forth in claim 1 above on a calibrated fulcrum scale device and obtaining the corresponding swing weight scale designation for each such balanced club;

(b) obtaining a second plurality of golf clubs wherein each club in said second plurality of clubs corresponds substantially in length and weight with a corresponding club in said plurality of clubs defined in claim 1; and (c) balancing any one of the clubs in said second plurality of golf clubs on a calibrated fulcrum scale device to the same swing weight scale designation as determined for the corresponding club in said plurality of golf clubs defined in claim 1.

3. A method for balancing a plurality of golf clubs comprising the following steps:

(a) having a golfer select a reference golf club;

(b) determining the shaft or center of percussion length and the center of gravity location of said reference club;

(c) using the equation $$EPL = \frac{2Q + r}{3}$$

where

EPL=the equivalent pendulum length of the club,

Q=the shaft or center of percussion length of the club, and r=the distance from the center of gravity of the club to the grip end, calculating the equivalent pendulum length for the reference club;

(d) determining the shaft or center of percussion length of each club in said plurality of clubs to be balanced;

(e) using the equation set forth above in step (c), calculating the new center of gravity location r for each club in said plurality of clubs to be balanced based upon the corresponding shaft or center of percussion length Q associated respectively with each such club as determined in step (d) above and the selected equivalent pendulum length EPL of the reference club; and (f) balancing each such club in said plurality of clubs at its new center of gravity location determined in step (e) above.

4. A plurality of golf clubs each comprising a club shaft, a grip and a club head, each club in said plurality of clubs being balanced about a center of gravity location on said club shaft such that all of said clubs have the same equivalent pendulum length, said center of gravity location for each respective club being based upon the center of percussion length associated with each respective club and said equivalent pendulum length value, said equivalent pendulum length value being defined by the equation $$EPL = \frac{2Q + r}{3}$$

where EPL=the equivalent pendulum length of the club, Q=the center of percussion length of the club, and r=the distance from the center of gravity of the club to the grip end.

5. A method for balancing a golf club to a selected equivalent pendulum length, said method comprising the following steps:

(a) selecting a predetermined equivalent pendulum length value;

(b) determining the shaft or center of percussion length of the club to be balanced;

(c) using the equation $$EPL = \frac{2Q + r}{3}$$

where

EPL=the equivalent pendulum length of the club,

Q=the shaft or center of percussion length of the club, and r=distance from the center of gravity of the club to the grip end, calculating the new center of gravity length r for the club to be balanced based upon the corresponding shaft or center of percussion length Q for such club as determined in step (b) above and the predetermined equivalent pendulum length value EPL as selected in step (a) above; and (d) balancing said club at its new center of gravity location determined in step (c) above.

6. A method for balancing a plurality of golf clubs wherein each of said plurality of golf clubs is balanced to the same equivalent pendulum length, said method comprising the following steps:

(a) selecting a predetermined equivalent pendulum length value;

(b) selecting a reference plurality of clubs to be balanced to the selected equivalent pendulum length value;

(c) determining the shaft or center of percussion length associated with each club in said reference plurality of clubs;

(d) determining the new anticipated center of gravity location for each club in said reference plurality of clubs using the selected equivalent pendulum length value and the equation $$EPL = \frac{2Q + r}{3}$$

where

EPL=the equivalent pendulum length of the club,

Q=the shaft or center of percussion length of the club, and r=distance from the center of gravity of the club to the grip end;

(e) balancing each club in said reference plurality of clubs at its respective new anticipated center of gravity location;

(f) determining the amount of additional balance weight which was added to each of said reference plurality of clubs in order to balance each such club to the selected predetermined equivalent pendulum length value;

(g) obtaining a second plurality of golf clubs wherein each club in said second plurality of clubs corresponds substantially in length and weight with a corresponding club in said reference plurality of clubs; and (h) balancing any one of the clubs in said second plurality of golf clubs by adding additional weight to the grip side thereof, said additional weight being substantially identical to the balance weight added to the corresponding club in said reference plurality of golf clubs such that when said club is thereafter positioned on a fulcrum, such club will be balanced at the new anticipated center of gravity length r determined for the corresponding club in said reference plurality of golf clubs.

7. A method for balancing a plurality of golf clubs wherein each of said plurality of clubs are balanced to the same equivalent pendulum length, said method comprising the following steps:

(a) selecting a predetermined equivalent pendulum length value;

(b) determining the shaft or center of percussion length of each club in said plurality of clubs;

(c) using the equations $$EPL = \frac{Q + K}{2}$$

and $K=\sqrt{Q \times r}$ where

EPL=the equivalent pendulum length of the club,

Q=the shaft or center of percussion length of the club, r=the distance from the center of gravity of the club to the grip end, and K=the radius of gyration of the club, calculating the new anticipated center of gravity length r for each club in said plurality of clubs based upon the corresponding shaft or center of percussion length Q associated respectively therewith and the selected equivalent pendulum length value EPL; and (d) balancing each of said plurality of clubs at its respective new anticipated center of gravity location.

8. The method defined in claim 7 further comprising the following additional steps:

(a) placing each of said plurality of clubs balanced in accordance with the method set forth in claim 7 above on a calibrated fulcrum scale device and obtaining the corresponding swing weight scale designation for each such balanced club;

(b) obtaining a second plurality of golf clubs wherein each club in said second plurality of clubs corresponds substantially in length and weight with a corresponding club in said plurality of clubs defined in claim 7; and (c) balancing any one of the clubs in said second plurality of golf clubs on a calibrated fulcrum scale device to the same swing weight scale designation as determined for the corresponding club in said plurality of golf clubs defined in claim 7.

9. A method for balancing a plurality of golf clubs comprising the following steps:

(a) having a golfer select a reference golf club;

(b) determining the shaft or center of percussion length and the center of gravity location of said reference club;

(c) using the equations $$EPL = \frac{Q + K}{2}$$

and $K=\sqrt{Q \times r}$ where

EPL=the equivalent pendulum length of the club,

Q=the shaft or center of percussion length of the club, r=the distance from the center of gravity of the club to the grip end, and K=the radius of gyration of the club, calculating the equivalent pendulum length for the reference club;

(d) determining the shaft or center of percussion length of each club in said plurality of clubs to be balanced;

(e) using the equations set forth above in step (c), calculating the new center of gravity location r for each club in said plurality of clubs to be balanced based upon the corresponding shaft or center of percussion length Q associated respectively with each such club as determined in step (d) above and the selected equivalent pendulum length EPL of the reference club; and (f) balancing each such club in said plurality of clubs at its new center of gravity location determined in step (e) above.

10. A plurality of golf clubs each comprising a club shaft, a grip and a club head, each club in said plurality of clubs being balanced about a center of gravity location on said club shaft such that all of said clubs have the same equivalent pendulum length, said center of gravity location for each respective club being based upon the center of percussion length associated with each respective club and said equivalent pendulum length value, said equivalent pendulum length value being defined by the equations $$EPL = \frac{Q + K}{2}$$

and $K=\sqrt{Q \times r}$ where EPL=the equivalent pendulum length of the club, Q=the center of percussion length of the club, r=the distance from the center of gravity of the club to the grip end, and K=the radius of gyration of the club.

11. A method for balancing a golf club to a selected equivalent pendulum length, said method comprising the following steps:

(a) selecting a predetermined equivalent pendulum length value;

(b) determining the shaft or center of percussion length of the club to be balanced;

(c) using the equations $$EPL = \frac{Q + K}{2}$$

and $K=\sqrt{Q \times r}$ where

EPL=the equivalent pendulum length of the club,

Q=the shaft or center of percussion length of the club, r=the distance from the center of gravity of the club to the grip end, and K=the radius of gyration of the club, calculating the new center of gravity length r for the club to be balanced based upon the corresponding shaft or center of percussion length Q for such club as determined in step (b) above and the predetermined equivalent pendulum length value EPL as selected in step (a) above; and (d) balancing said club at its new center of gravity location determined in step (c) above.

12. A method for balancing a plurality of golf clubs wherein each of said plurality of golf clubs is balanced to the same equivalent pendulum length, said method comprising the following steps:

(a) selecting a predetermined equivalent pendulum length value;

(b) selecting a reference plurality of clubs to be balanced to the selected equivalent pendulum length value;

(c) determining the shaft or center of percussion length associated with each club in said reference plurality of clubs;

(d) determining the new anticipated center of gravity location for each club in said reference plurality of clubs using the selected equivalent pendulum length value and the equations $$EPL = \frac{Q + K}{2}$$

and $K=\sqrt{Q \times r}$ where

EPL=the equivalent pendulum length of the club,

Q=the shaft or center of percussion length of the club, r=the distance from the center of gravity of the club to the grip end, and K=the radius of gyration of the club;

(e) balancing each club in said reference plurality of clubs at its respective new anticipated center of gravity location;

(f) determining the amount of additional balance weight which was added to each of said reference plurality of clubs in order to balance each such club to the selected predetermined equivalent pendulum length value;

(g) obtaining a second plurality of golf clubs wherein each club in said second plurality of clubs corresponds substantially in length and weight with a corresponding club in said reference plurality of clubs; and (h) balancing any one of the clubs in said second plurality of golf clubs by adding additional weight to the grip side thereof, said additional weight being substantially identical to the balance weight added to the corresponding club in said reference plurality of golf clubs such that when said club is thereafter positioned on a fulcrum, such club will be balanced at the new anticipated center of gravity length r determined for the corresponding club in said reference plurality of golf clubs.

13. A method for balancing a plurality of golf clubs wherein each of said plurality of clubs are balanced to the same equivalent pendulum length, said method comprising the following steps:

(a) selecting a predetermined equivalent pendulum length value;

(b) determining the shaft or center of percussion length of each club in said plurality of clubs;

(c) using the equations $EPL=\sqrt{Q \times K}$ and $K=\sqrt{Q \times r}$ where

EPL=the equivalent pendulum length of the club,

Q=the shaft or center of percussion length of the club, r=the distance from the center of gravity of the club to the grip end, and K=the radius of gyration of the club, calculating the new anticipated center of gravity length r for each club in said plurality of clubs based upon the corresponding shaft or center of percussion length Q associated respectively therewith and the selected equivalent pendulum length value EPL; and (d) balancing each of said plurality of clubs at its respective new anticipated center of gravity location.

14. The method defined in claim 13 further comprising the following additional steps:

(a) placing each of said plurality of clubs balanced in accordance with the method set forth in claim 13 above on a calibrated fulcrum scale device and obtaining the corresponding swing weight scale designation for each such balanced club;

(b) obtaining a second plurality of golf clubs wherein each club in said second plurality of clubs corresponds substantially in length and weight with a corresponding club in said plurality of clubs defined in claim 13; and (c) balancing any one of the clubs in said second plurality of golf clubs on a calibrated fulcrum scale device to the same swing weight scale designation as determined for the corresponding club in said plurality of golf clubs defined in claim 13.

15. A method for balancing a plurality of golf clubs comprising the following steps:

(a) having a golfer select a reference golf club;

(b) determining the shaft or center of percussion length and the center of gravity location of said reference club;

(c) using the equations $EPL=\sqrt{Q \times K}$ and $K=\sqrt{Q \times r}$ where

EPL=the equivalent pendulum length of the club,

Q=the shaft or center of percussion length of the club, r=the distance from the center of gravity of the club to the grip end, and K=the radius of gyration of the club, calculating the equivalent pendulum length for the reference club;

(d) determining the shaft or center of percussion length of each club in said plurality of clubs to be balanced;

(e) using the equations set forth above in step (c), calculating the new center of gravity location r for each club in said plurality of clubs to be balanced based upon the corresponding shaft or center of percussion length Q associated respectively with each such club as determined in step (d) above and the selected equivalent pendulum length EPL of the reference club; and (f) balancing each such club in said plurality of clubs at its new center of gravity location determined in step (e) above.

16. A plurality of golf clubs each comprising a club shaft, a grip and a club head, each club in said plurality of clubs being balanced about a center of gravity location on said club shaft such that all of said clubs have the same equivalent pendulum length, said center of gravity location for each respective club being based upon the center of percussion length associated with each respective club and said equivalent pendulum length value, said equivalent pendulum length value being defined by the equations $EPL=\sqrt{Q\times K}$ and $K=\sqrt{Q\times r}$ where EPL=the equivalent pendulum length of the club, Q=the center of percussion length of the club, r=the distance from the center of gravity of the club to the grip end, and K=the radius of gyration of the club.

17. A method for balancing a golf club to a selected equivalent pendulum length, said method comprising the following steps:

(a) selecting a predetermined equivalent pendulum length value;

(b) determining the shaft or center of percussion length of the club to be balanced;

(c) using the equations $EPL=\sqrt{Q\times K}$ and $K=\sqrt{Q\times r}$ where
EPL=the equivalent pendulum length of the club,
Q=the shaft or center of percussion length of the club,
r=the distance from the center of gravity of the club to the grip end, and
K=the radius of gyration of the club,
calculating the new center of gravity length r for the club to be balanced based upon the corresponding shaft or center of percussion length Q for such club as determined in step (b) above and the predetermined equivalent pendulum length value EPL as selected in step (a) above; and (d) balancing said club at its new center of gravity location determined in step (c) above.

18. A method for balancing a plurality of golf clubs wherein each of said plurality of golf clubs is balanced to the same equivalent pendulum length, said method comprising the following steps:

(a) selecting a predetermined equivalent pendulum length value;

(b) selecting a reference plurality of clubs to be balanced to the selected equivalent pendulum length value;

(c) determining the shaft or center of percussion length associated with each club in said reference plurality of clubs;

(d) determining the new anticipated center of gravity location for each club in said reference plurality of clubs using the selected equivalent pendulum length value and the equations $EPL=\sqrt{Q\times K}$ and $K=\sqrt{Q\times r}$ where
EPL=the equivalent pendulum length of the club,
Q=the shaft or center of percussion length of the club,
r=the distance from the center of gravity of the club to the grip end, and
K=the radius of gyration of the club;

(e) balancing each club in said reference plurality of clubs at its respective new anticipated center of gravity location;

(f) determining the amount of additional balance weight which was added to each of said reference plurality of clubs in order to balance each such club to the selected predetermined equivalent pendulum length value;

(g) obtaining a second plurality of golf clubs wherein each club in said second plurality of clubs corresponds substantially in length and weight with a corresponding club in said reference plurality of clubs; and (h) balancing any one of the clubs in said second plurality of golf clubs by adding additional weight to the grip side thereof, said additional weight being substantially identical to the balance weight added to the corresponding club in said reference plurality of golf clubs such that when said club is thereafter positioned on a fulcrum, such club will be balanced at the new anticipated center of gravity length r determined for the corresponding club in said reference plurality of golf clubs.

* * * * *